United States Patent [19]

Martin et al.

[11] Patent Number: 4,656,452

[45] Date of Patent: Apr. 7, 1987

[54] TRANSFORMER TELEPHONE INFLUENCE TRACTOR CORE SHUNT

[75] Inventors: Charles M. Martin; Wayne W. Lien, both of Waukesha, Wis.

[73] Assignee: RTE Corporation, Waukesha, Wis.

[21] Appl. No.: 796,419

[22] Filed: Nov. 8, 1985

[51] Int. Cl.[4] ..... H01F 17/06; H01F 27/26

[52] U.S. Cl. ..... 336/178; 336/212; 336/217; 336/218; 336/219

[58] Field of Search ..... 336/212, 219, 218, 216, 336/217, 178, 134, 213, 219, 84 M, 165, 160

[56] References Cited

U.S. PATENT DOCUMENTS

| | | | |
|---|---|---|---|
| 1,251,700 | 1/1918 | Shaw | 336/84 M |
| 1,897,040 | 2/1933 | Christopher | 336/178 |
| 2,180,759 | 11/1939 | Kneisley | 336/212 X |
| 2,422,591 | 6/1947 | Sigmund et al. | 336/219 X |
| 3,538,472 | 11/1970 | Bell et al. | 336/212 X |
| 3,639,872 | 2/1972 | Hessen et al. | 336/212 X |
| 3,750,070 | 7/1973 | Rissinger | 336/212 X |
| 3,983,523 | 9/1976 | Ayers | 336/212 X |

FOREIGN PATENT DOCUMENTS

| | | | |
|---|---|---|---|
| 33814 | 2/1983 | Japan | 336/217 |
| 33815 | 2/1983 | Japan | 336/217 |
| 33816 | 2/1983 | Japan | 336/217 |

*Primary Examiner*—Thomas J. Kozma

[57] ABSTRACT

A core shunt packet for reducing the telephone influence factor in a transformer of the type having a core formed from strips of magnetic material arranged in end-to-end relation forming a series of staggered gaps at one end of the core, the core shunt packets including one or more steel laminations mounted in an envelope, the envelope being mounted on the side of the core in a position to bridge the gap area on the core with a sheet of insulation located between the envelope and the side of the core.

5 Claims, 3 Drawing Figures

TRANSFORMER TELEPHONE INFLUENCE TRACTOR CORE SHUNT

BACKGROUND OF THE INVENTION

Transformer cores are made of many individual laminations or sheets. As these sheets are added, there is a small gap between the end of one sheet and the start of the next. These gaps are staggered across the core in a set pattern which repeats after a plurality of sheets. These cores are designed to operate at a specific flux density which is normally close to the optimum design level. Higher density causes the exciting current to increase significantly and lower density is inefficient.

In the ideal case, the gap between sheets would be zero and the flux in the steel would flow across the gap with no interruption. When the gap is greater than zero, then the reluctance of the path is increased greatly. In actual practice, the reluctance of the gap may be thousands of times higher than the steel. The flux will seek the lowest reluctance path. At the gap region, the cross-sectional area is reduced significantly. The flux density at the gap, therefore, is much higher than the rest of the core resulting in an increase in the exciting current and the fringing flux.

The noise generated by this increase in fringing flux in the transformer windings may be picked up by telephone lines in close proximity to the transformer resulting in noise heard by the telephone user. The irritation of noise to the average telephone user is referred to as telephone influence factor, TIF, which is a dimensionless quantity in accordance with the 1960 TIF weighting adopted by the "Edison Electric Institute." Weighting refers to the relationship of current-×time/KVA and is a measure of the nonlinear response of the human ear to the sounds from the telephone receiver.

SUMMARY OF THE INVENTION

The present invention is concerned with a flux shunt packet which is used to reduce the core exciting current, fringing flux and core losses and as a consequence reduces the associated noise heard by the telephone user, TIF. This has been accomplished by preparing laminated core steel packets and placing the packets over the gap areas on each side of the transformer core. These packets are designed to provide a lower reluctance path for the fringing flux and to enhance the cross section of the core at the gap area thereby reducing the flux density and as a consequence reduces the exciting current and the resultant TIF. The shunt packets may be made of any magnetic material which will reduce the overall reluctance in the gap area of the transformer to that of the rest of the core. The most efficient cost effective material is core steel. The grain orientation of the steel packets should be in the same direction as the grain orientation of the core steel in the transformer. It has been found that for best results, the thickness of the packet should be proportional to the reduction of the cross sectional area of the transformer due to the arrangement of the gaps between the ends of the core laminations in the transformer. The shunt packets may also be used in areas where high fringing flux is encountered, such as at the corners and at the core edges.

One of the advantages obtained in using core shunt packets is that the core steel can be used at a higher flux density without developing the high fringing flux at the high density regions, such as the gap sections. The packets are used to selectively increase the amount of magnetic material in the cross sectional areas of the core and to capture and thereby retain the fringing flux in a more efficient medium.

IN THE DRAWINGS

DESCRIPTION OF THE INVENTION

Figure 1:
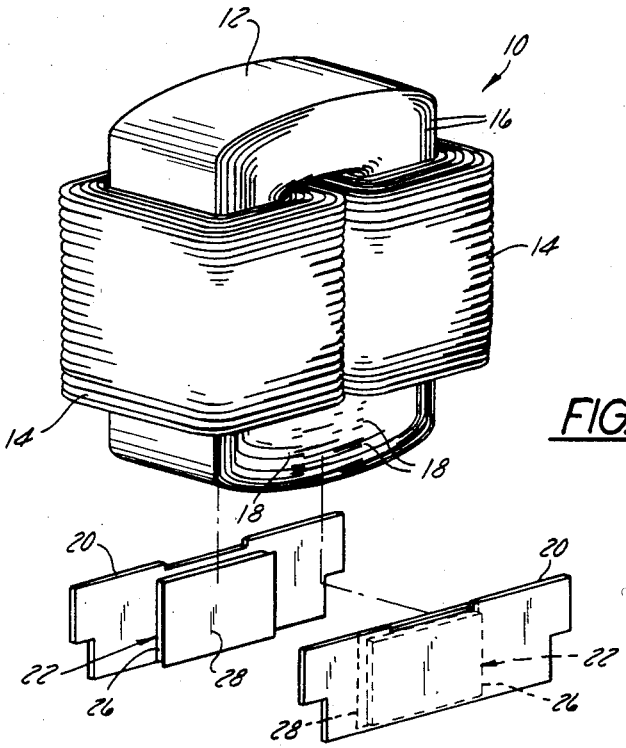
FIG. 1 is a perspective view showing a transformer core and coil assembly with a core shunt packet mounted on each of the core blocks that are mounted on each side of the gap area in the transformer core.
Figure 2:
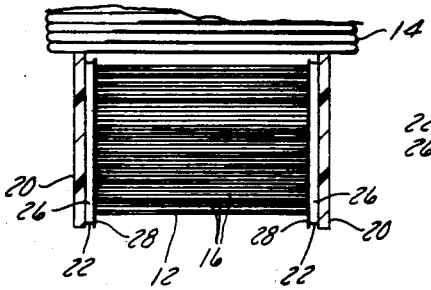
FIG. 2 is an end view of FIG. 1 showing the core shunt packets located on each side of the transformer core.
Figure 3:
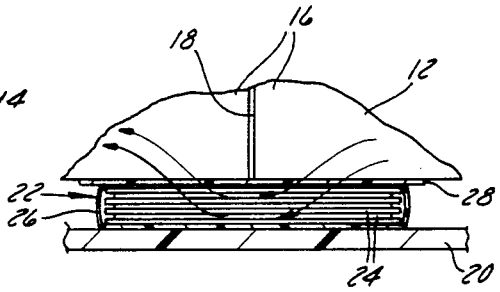
FIG. 3 is an enlarged section view of a portion of the bottom of the transformer showing the flux path around the gap area through one of the shunt packets and back to the core.

Referring to FIGS. 1 and 2 of the drawing, a typical transformer 10 is shown having a laminated core 12 and coils 14. The core is formed from strips of core steel 16 which have been previously formed, annealed and cut to the required lengths. The strips 16 are then opened and inserted through the center opening of the coils 14 to form the coil-core assemblies. As is generally understood in the art, the laminations 16 after insertion through the coils are closed to form the core loop, however a series of gaps 18 will be present between the ends of each lamination which are staggered or offset as shown in FIG. 1. Core blocks 20 are normally provided on each side of the core at both the top and bottom and a core clamp (not shown) is mounted on each end to hold the core blocks 20 in position. The clamps are held in position by steel straps (not shown) which are wrapped around the core 12 and the clamps at each end of the core.

In accordance with the present invention, core shunt packets 22 are provided on the inside of the core blocks which are positioned on each side of the area of the gaps 18 in the core 12. The packets 22 are located in a position to bridge the entire area where the staggered gaps 18 are located, thus, providing a shunt path for the fringing flux across the area of the gaps 18.

Each of the packets 22 includes a number of core steel plates 24, six to nine in number, arranged in the form of a laminated block which is placed in an envelope 26 that is secured to the inside surface of the core block 20 by an appropriate adhesive. A sheet of insulation 28 such as Nomax or a cellular material, is placed on the exposed surface of the packet 22 to insulate the packet from the transformer core.

The number of laminations required in each packet is dependant of the number of gaps existing in a cross section of the transformer. Since each gap reduces the amount of magnetic material in a particular cross sectional area of the core, the packets of magnetic material should have a thickness sufficient to compensate for loss of magnetic material in the cross sectional areas of the core.

This could consist of one or more laminations in each packet depending on the thickness of material required to compensate for the area having the smallest cross sectional area of magnetic material.

High flux density may exist in other locations in the core such as in the corners or edges of the core where high stress areas may be present. By placing high permeable material such as steel laminations in close proximity to the high density areas, the high flux density can be reduced in these areas. This is due to the permeability material becoming magnetically linked to the core, reducing the flux density and as a consequence reducing the exciting current, fringing flux and the associated Telephone Influence Factor, TIF.

In a test run on a pair of packets containing six laminations, provided on both sides of the transformer core, a TIF of 100 without the packets was reduced to a TIF of approximately 50 or ½ of the normal TIF in a 25 KVA transformer.

The embodiments of the invention in which an exclusive property or privilege is claimed, are defined as follows:

1. The combination with a transformer of the type having an enclosed core and an electrical coil assembly mounted on each of the legs of the core, said core being formed from a flat continuous strip of magnetic material which is spirally wound into a plurality of concentric superposed turns, said strips being cut to form a plurality of strips having a length equal to slightly less than one complete turn in said core to form a series of staggered gaps between the ends of the strips at one end of said core with a corresponding high flux density area, the improvement comprising a shunt packet mounted in abutting relation to each side of said core in a position to bridge the high flux density area at said one end of the core, each shunt packet including one or more steel laminations, said laminations having a thickness corresponding to the difference in the cross sectional area of the core and the cross sectional area of the core through the air gaps at said one end of the core.

2. The combination according to claim 1 wherein the grain orientation of said laminations is aligned with the flux flow path of the core.

3. The combination according to claim 1 wherein said laminations are enclosed in an envelope.

4. The combination according to claim 3 wherein said transformer includes a core block positioned on each side of each end of said core, said shunt packets being mounted on the inside surface of the core blocks located at the high flux density area of said core.

5. The combination according to claim 4 including a sheet of insulation positioned between said laminations and said core.

* * * * *